United States Patent [19]

Weber

[11] Patent Number: 4,856,191

[45] Date of Patent: Aug. 15, 1989

[54] CUTTER AND GUIDE FOR WALL COVERINGS AND FLOOR COVERINGS

[76] Inventor: Andreas Weber, Ludwigstr. 8, D 6078 Neu-Isenburg, Fed. Rep. of Germany

[21] Appl. No.: 932,035

[22] Filed: Nov. 18, 1986

[30] Foreign Application Priority Data

Mar. 12, 1986 [DE] Fed. Rep. of Germany ..... 3608147

[51] Int. Cl.[4] ..... B26B 27/00

[52] U.S. Cl. ..... 30/123; 30/293; 30/294

[58] Field of Search ..... 30/286, 288, 289, 290, 30/293, 294, 123; 83/743

[56] References Cited

FOREIGN PATENT DOCUMENTS 1553763 7/1970 Fed. Rep. of Germany .
2015843 10/1970 Fed. Rep. of Germany .
2130043 1/1972 Fed. Rep. of Germany .
7804744 6/1978 Fed. Rep. of Germany .
2822844 12/1978 Fed. Rep. of Germany .
2005179 4/1979 United Kingdom ..... 30/294

*Primary Examiner*—Douglas D. Watts
*Attorney, Agent, or Firm*—Marmorek, Guttman & Rubenstein

[57] ABSTRACT

A cutting device for wall coverings comprises a cutting rail and an electric scissor which can be introduced into the cutting rail, wherein the cutting rail comprises a plastic extruded profile segment with a triangular cross-section, and wherein the electric scissors is equipped with shearing blades aligned so that the cutting direction is oriented towards the body of the operator. The combined device makes it possible to obtain a clean cut without great expenditure of force, even under difficult working conditions.

4 Claims, 9 Drawing Sheets

CUTTER AND GUIDE FOR WALL COVERINGS AND FLOOR COVERINGS

BACKGROUND OF THE INVENTION

The present invention relates to a cutting device for wall coverings and floor coverings.

Guidance devices for cutting or trimming a wallpaper strip or similar materials are known. Thus, for example, a guidance device is known from DE-OS No. 28 22 844, consisting of a profile which defines an application surface for support on one wall and a bearing surface for the strip to be trimmed and consisting furthermore of a guiding device for a knife. A groove in the bearing surface serves as the guiding device.

DE-GM No. 78 04 744 describes a cutting ruler for the cutting of material in the form of strips, such as wallpaper or carpet strips, consisting of an extrusion profile segment with a cross-section essentially in the form of a T with a shank in central location on a mostly even-surfaced profile flange, said shank being even-surfaced. The height of the shank is about equal to one half of the flange width, whereby a cutting groove, running parallel to the length of the profile is provided on the outer surface of the flange, approximately at its center, on at least one flange half.

All the guiding devices mentioned above have the disadvantage of tending to press themselves into the wall covering material, especially if the material is soft, because of the guiding devices' T-shaped configurations. These devices furthermore lack stability.

The strip material is generally cut with sharp knives to the required dimensions. Electric knives or scissors by means of which cutting can be effected are also known.

Thus, for example, DE-OS No. 15 53 763 describes an electrically driven scissor with two shanks supported in the scissor housing and bearing the scissor blades. The first shank is coupled to an electric drive and is capable of being swivelled around a scissor axis, while the second shank is fixedly supported in the housing.

A similar electric shearing device with one fixed and one oscillating, driven shearing knife, is described in DE-OS No. 20 15 846.

DE-OS No. 21 30 043 discloses an electric knife with a housing in which an electrically driven motor, a normally stationary counterblade and a second blade are installed. The second blade can be made to oscillate by the motor that is equipped with a driving mechanism which connects the motor to the second blade so that the second blade can be oscillated in and out of cutting action with the fixed counterblade.

The above-mentioned electric cutting devices are not particularly well-suited for cutting material strips as such a device produce an uneven cut.

It has furthermore been found that the uneven cut is, among other reasons, caused by the fact that the cutting devices are cutting forward, as scissors normally do, and thus catch on the material. However, if cutting is done backward, as would normally be the case with a knife, the cut becomes much more even.

It is the objective of the instant invention to create a cutting device for wall coverings which makes possible better adherence of the device to walls, even soft walls, and by means of which a clean, even cut can be obtained without great expenditure of force.

SUMMARY OF THE INVENTION

This objective is attained in the cutting device of the present invention which comprises a cutting rail and an electric scissor which can be introduced into the cutting rail. The cutting rail comprises a plastic extrusion profile segment with a triangular cross-section, with two shorter support surfaces and one longer bearing surface. The bearing surface is provided with three or more cutting grooves which run parallel to the cutting edges of the support surfaces and of the bearing surface. The distance from one of the cutting grooves to the cutting edge of the bearing surface and the support surface is equal to the length of the support surface. The other cutting grooves are at a greater distance.

The electric scissor is of a known type, with a housing and drive motor. It is equipped with a fixed counterblade and a shearing blade driven by the drive motor. The cutting direction of said scissor, as seen from the movable scissor blade or from the fixed counter blade, is towards the housing. The width of the counterblade is adapted to the width of the cutting grooves.

The task of the invention is achieved through the combined action of the electric scissor and the shearing blade or the counterblade, oriented in the direction of the handle and the width of the cutting grooves in the cutting rail, which is adapted to the width of the shearing blade or counterblade. Easy guidance of the scissor in the cutting rail is thus made possible. The scissor can be guided without great pressure in the cutting groove and the special configuration of the scissor makes it possible to obtain a clean and even cut.

To fit out normal rooms with wall coverings, the cross-section of the cutting rail should preferably be in the form of a right triangle. However, it is also possible to imagine designs with different cross-sections for rooms having corners which are not at right angles.

The plastic extrusion profile segment making up the cutting rail can be provided with internal reinforcement ribs for greater rigidity, for instance between the bearing surface and the longer of the two support surfaces.

Since the distance between one of the cutting grooves and one of the support surfaces is equal to the length of the longer support surface, the wall covering is given a precise length as it is cut in this cutting groove, said length reaching precisely into the cutting edge of the corner of the room when it is cut off in this cutting groove. Precise abutting or ending of the wall covering at the cutting edge of the corner of the room is achieved. The other cutting grooves which are at a greater distance from the cutting edge of the bearing surface and of the support surface are provided in case an extension beyond the cutting edge of the corner of the room is desired, as would be appropriate, for example, when the same wall covering is to be installed on either side of the cutting edge. In such instance, one of the wall coverings is preferably allowed to extend somewhat over the cutting edge and a second, exactly trimmed wall covering, is then wallpapered over it. Even if a door jamb or a sill are to be wallpapered with overlap, the other cutting grooves can be used.

The cutting edge of the two support surfaces is preferably rounded off. This makes it possible to obtain clean wallpapering on irregular edges, damage to the cutting edge is avoided and the cutting rail is able to lie flat against the wall, even if the room corners are not exactly at a right angle.

In a preferred embodiment the depth of the cutting groove is less than the height h of the fixed counterblade up to its stop on the scissor housing. In an embodiment of such a design, the fixed counterblade touches the floor of the cutting groove during the cutting process while the stop of the blades on the housing is free and does not touch the bearing surface. Damage to the wall covering material to be cut is thus avoided, friction of the blades against the cutting rail is kept to a minimum and the electrical scissor is guided easily within the cutting groove. Since most wall covering materials are relatively thin the depth of the cutting groove is preferably kept to 0.5 to 2 mm less tha the height of the fixed counterblade.

One of the two support surfaces of the plastic extrusion profile can be extended beyond the cutting line with the bearing surface, whereby a protrusion in the form of a protruding nose results. A piece of wallpaper above the cutting edge which, for example, may be coated with adhesive, adheres to the nose after cutting without touching the wall and can be easily removed once the cutting rail is removed.

Since the cut is not made with a conventional wallpaper knife, the cutting rail can be considerably thinner than earlier cutting rails and does not require any metal guiding parts. This lightens its weight considerably and less force is therefore required to hold the cutting rail.

The plastic extrusion profile of the cutting rail can easily be filled with light foam to increase stability.

The bearing surface of the cutting rail can be arched upward in an embodiment of the invention of yet another design. This makes it possible to move the cutting grooves from an oblique position into more of a horizontal position as this ensures better positioning for cutting with the electric scissor, i.e., more at a horizontal cutting. It is also easier in this way to move the hand which holds the scissor past the hand which guides the cutting rail.

It is furthermore possible to angle the bearing surfaces so that an edge of increased height is formed on same, whereby the cutting grooves lie in the one which is at a lower angle to the wall. This also affords the above-mentioned advantages.

In an embodiment especially designed to cut wall coverings and floor coverings, the cutting rail comprises an extruded profile segment with a smooth surface, provided with one or several cutting grooves. Clamping devices are provided on the surface of the cutting rail to clamp down the wall or floor coverings to be cut. The clamping devices can be made in the form of pinch rolls, but they can also comprise clamping surfaces capable of being pressed against the surface of the cutting rail by locking screws or similar devices to hold down the wall or floor coverings to be cut.

The electric scissor comprises a housing with a drive motor which imparts an oscillating movement to one of the two blades, while the other blade is a fixed counterblade against which the movable blade oscillates. Such scissors with blades and wherein the cutting direction is away from the housing are known. Although they have been used in the past to cut paper and similar material, it has not been possible to put such scissors into general use for cutting wallpaper.

Thorough investigation has shown that this is due, among other reasons, to the fact that electric scissors easily catch on rough spots in the cutting grooves, such as for examples remnants of wallpaper or adhesive, or on dammed-up wallpaper itself, when wallpaper is cut by pushing the scissor, so that an uneven cut results. The electric scissor also tends to jam as it is pushed forward, and this also causes it to catch on rough spots.

Surprisingly, this disadvantage in the combination of cutting rail and electric scissor can be avoided if the cutting direction of the electric scissor is reversed, so that the operator no longer cuts away from himself but towards his body. For this purpose, the electric scissor must be made so that the cutting direction of the movable blade goes towards the housing, as seen from the swivelling point of the movable scissor blade. It is furthermore necessary that the width of the shearing blade be adapted to the width of the cutting grooves in the cutting rail. By means of such a device, it is possible to obtain a simple, smooth cut which can be made even when wet wallpaper, having a great tendency to tear or stick, is involved.

To insure the most comfortable position possible for holding the electric scissor during the cutting procedure, the cutting edge of the fixed counterblade is preferably installed at an angle of 20° to 50°, and most preferably at an angle of approximately 30° to 40°, to the longitudinal axis of the electrical scissor. The scissor blade can be swivelled around an axis which is provided centrally or eccentrically in the shearing blade of parabolic or similar configuration. The shearing blade, i.e., the sharp, cutting portion of the shearing blade, is preferably installed within the plane between the axis and the shearing blade drive.

The electric scissor is equipped with a drive motor in a housing of a known type, said drive motor being used to drive the shearing blade which cuts in the direction of the housing, as seen from the shearing blade or from the fixed blade. In one embodiment the swivelling point of the driven shearing blade is located within the housing. In another embodiment, the swivelling point of the driven shearing blade lies outside the housing, at the outer end of said shearing blade.

It has been found that such a cutting device is also suitable to cut floor coverings, such as for example carpeting, floor mats, linoleum etc.

This invention is described in greater detail hereinbelow through the drawings, whereby all of the characteristics shown in these drawings are considered as being essential to the invention.

DETAILED DESCRIPTION OF THE INVENTION

Figure 1:
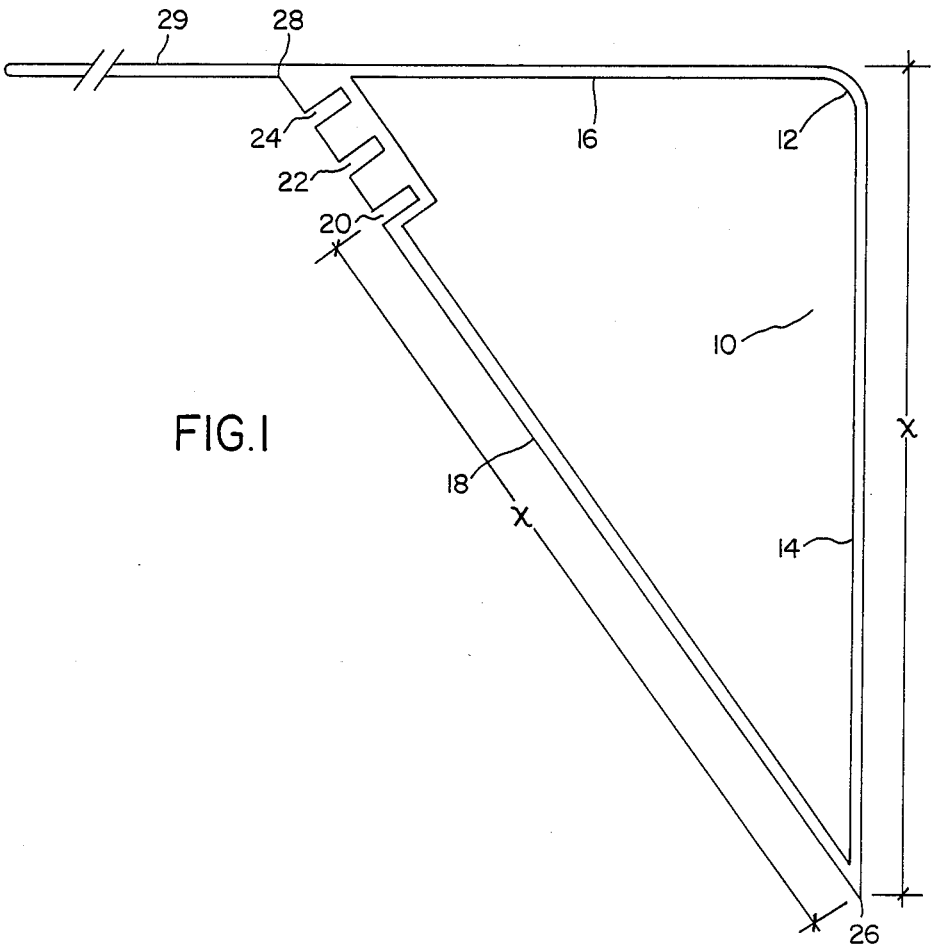
FIG. 1 shows a cutting rail with a total of three cutting grooves, in cross-section.

The cutting rail 10 has an extruded plastic profile 12 in the form of a right triangle. The support surfaces 14, 16, form the right angle of the triangle, by means of which the cutting rail 10 is applied against the wall and the ceiling of the room to be wallpapered such that the right angle lies in the angle of the room wall and room ceiling, support the cutting rail 10 against the room wall and ceiling. On the bearing surface 18 which lies across from the right angle, a total of three cutting grooves 20, 22, 24 are provided and are slit-like rectangular recesses in the bearing surface 18. The distance between the cutting groove 20 and the cutting edge 26 at the angle formed by the bearing surface 18 and the support surface 14, is equal to the length of bearing surface 14, so that a wall covering cut off in cutting groove 20 is made to reach precisely up to the corner of the room. The other cutting grooves 22, 24 are at a somewhat greater distance from the cutting edge 26 and a wall covering which is cut off in these cutting grooves overlaps the ceiling of the room. This is preferable when several walls, meeting at a corner of the room, are to be covered with the same wall covering. The cutting grooves are therefore closer to the cutting edge 28 formed by bearing surface 18 and the shorter bearing surface 16 than to the cutting edge 26.

Figure 2:
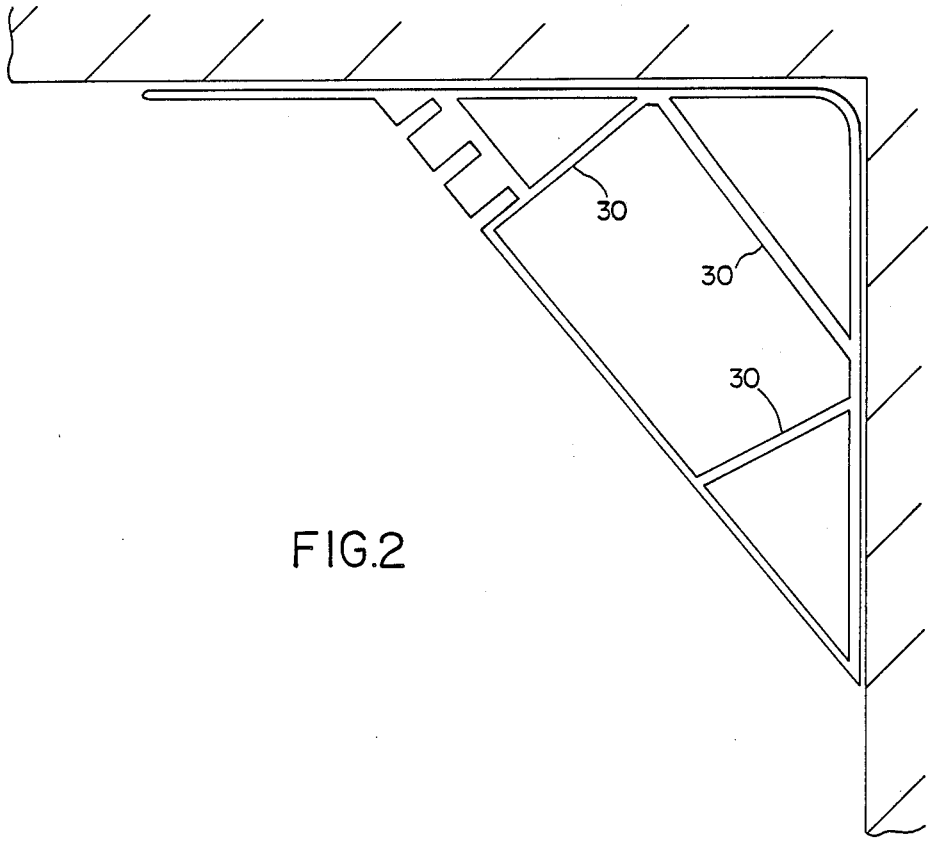
FIG. 2 shows another design of the cutting rail with reinforcement ribs, in cross-section.
Figure 3:
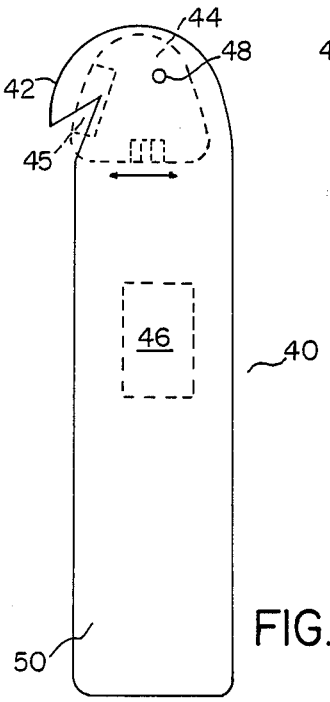
FIG. 3 shows an electric scissor in an overall general side-view.
Figure 4:
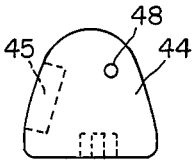
FIG. 4 shows the movable shearing blade in a side-view.
Figure 5:
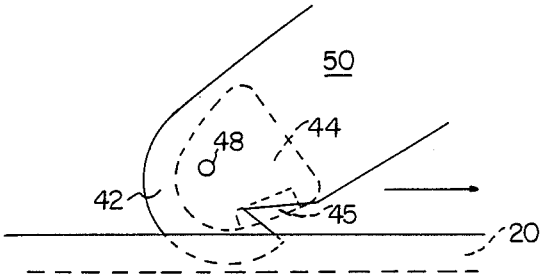
FIG. 5 shows the cutting process with the electric scissor guided in the cutting groove.
Figure 6:
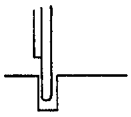
FIG. 6 is a side-view of FIG. 5.
Figure 7:
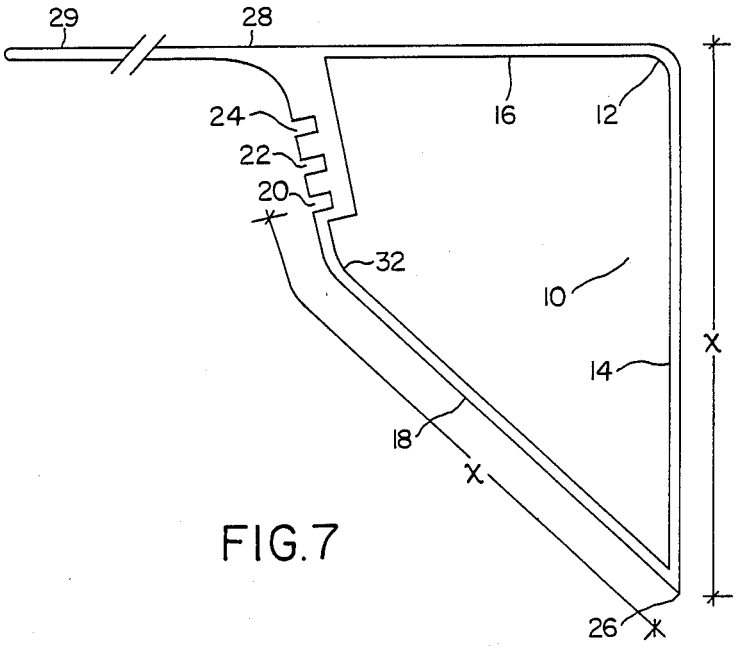
FIG. 7 shows a cross-section of a cutting rail with raised a edge on the bearing surface.
Figure 8:
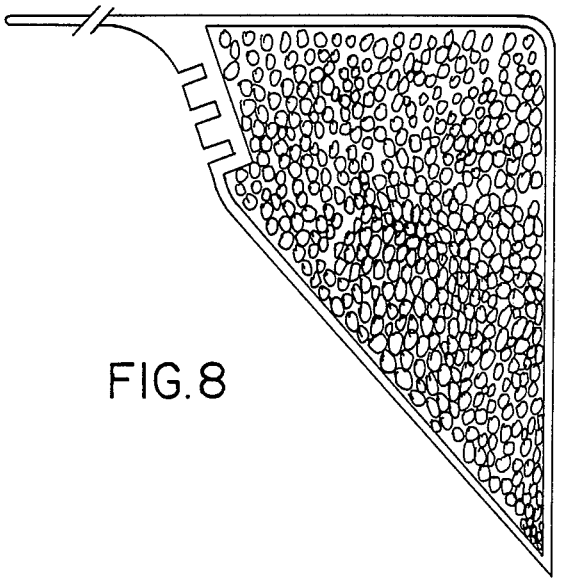
FIG. 8 shows a cross-section of a similar rail to that in FIG. 7, with internal light foam reinforcement.

The plastic extrusion profile 12 has a rectangular cross-section with a side ratio of 3:4:5. In the embodiment of the cutting rail 10 shown in FIG. 2 the plastic extruded profile is reinforced by internal reinforcement ribs 30 which extend from the bearing surface 18 to the two support surfaces 14, 16.

Figure 9:
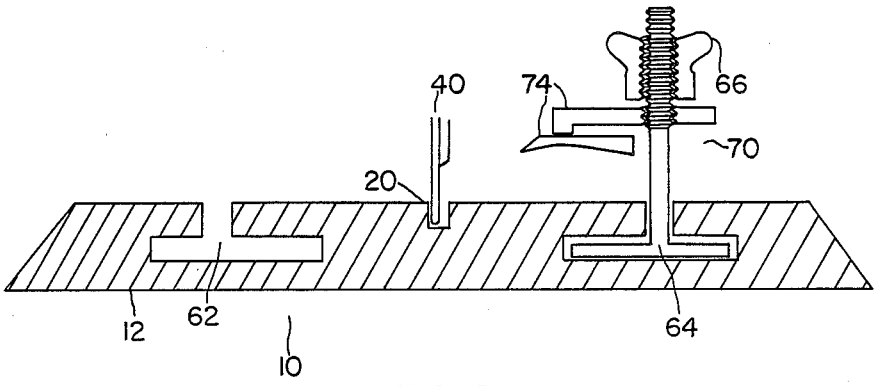
FIG. 9 shows a longitudinal section through an embodiment of the cutting rail with a clamping surface and a cutting groove with indication of the electric scissor.

The cutting rail 10 shown in FIG. 9, which is particularly well suited for cutting floor covering 56, has a flat, trapezoidal cross-section. The sides of extruded profile segment 12 are easily bevelled so that the material 56 to be cut can slide across easily. The surface of the extruded profile segment 12 is provided with cutting groove 20 in which the electric scissor 40 is guided.

Figure 10:
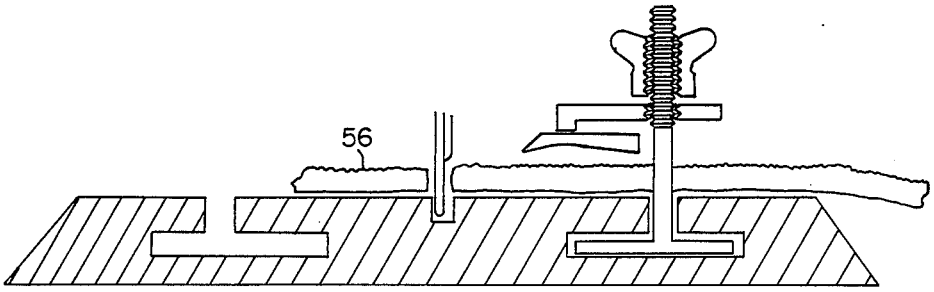
FIG. 10 shows the same longitudinal section as FIG. 9 with inserted and cut covering material.

The extruded profile segment 12 is furthermore provide with the recesses 62 in which the runners 64 can run, said runners being provided with clamping surfaces 74 which can be clamped down on the runners 64 by means of locking screws 66. The material 56 to be cut can be laid beneath the clamping surface 74 and can be clamped down with the clamping screws 66 of the clamping device 70 so that the material 56 to be cut can be cut with the electric scissor 40 without shifting. FIG. 10 shows how a carpet floor is clamped down and is cut in the clamping device 70.

Figure 11:
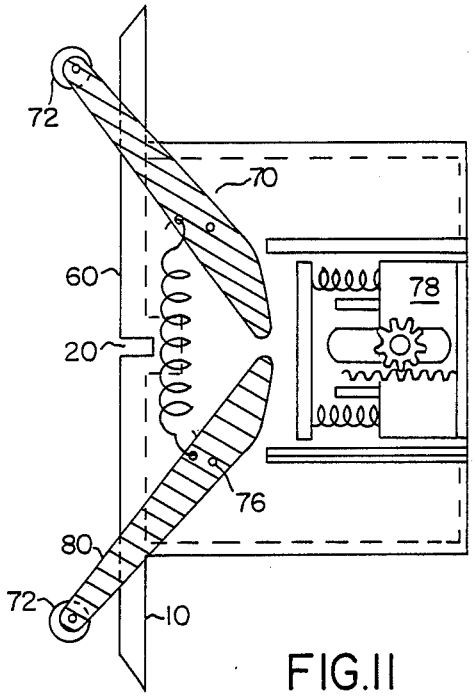
FIG. 11 shows a further embodiment of the cutting rail in longitudinal section, particularly suitable for cutting wall or floor coverings, for example in sales areas.

FIG. 11 shows a cutting device which is particularly adapted to cut off large sections of carpeting from carpet rolls such as would be used in a carpet store, etc. The carpet is guided downward from a carpet roll (not shown) located above the shown device, across surface 60 on the left side of the cutting device. At the same time the carpet is guided through underneath the clamping rollers 72 which are then swivelled around swivelling axis 76 as the pressing device 78 presses against the ends of the swivelling arm 80. In this manner the carpet is attached to the surface 60 and can be cut in groove 20 without shifting.

Referring to FIGS. 3–6, the electric scissor 40 comprises an oblong housing 50 which is made in the form of a handle in which a drive motor 46 is located. Drive motor 46 is connected to the driven shearing blade 44 via a transmission link, (not shown) which transforms the rotational movement of the motor into a swivelling motion, said shearing blade 44 being capable of swivelling up and down around a swivelling point 48. The swivelling movement occurs against the fixed counterblade 42, thus producing a cutting action. The complete assembly of housing 50 with drive motor 46 and transmission link is of the same type as known, commercially obtainable electric scissors.

It is the design of the shearing blade which is different from that of known scissors. While the blades are attached to the housing, in known scissors, so that the scissor is moved in a pushing movement, away from the body of the operator, the shearing blades of the inventive electric scissor are arranged so that the cutting movement takes place towards the body of the operator. The shearing blades are attached at one side of the housing 50 at an angle of approximately 20° to 50° to the longitudinal axis of the housing, and preferably at an angle of approximately 30° to 40°. The longitudinal axis of the housing is understood to be the axis which runs parallel to the longest extension of the housing. It can be seen from FIG. 5 that such an arrangement of angles makes it possible to guide the electric scissor especially well in the cutting groove, in a handy position, so that an easier and cleaner cutting operation is ensured. A person schooled in the art can recognize that such an arrangement of angles does not require a modification of the internal design of the electric scissor but that only the driven shearing blade and the fixed counterblade must be modified.

Figure 12:
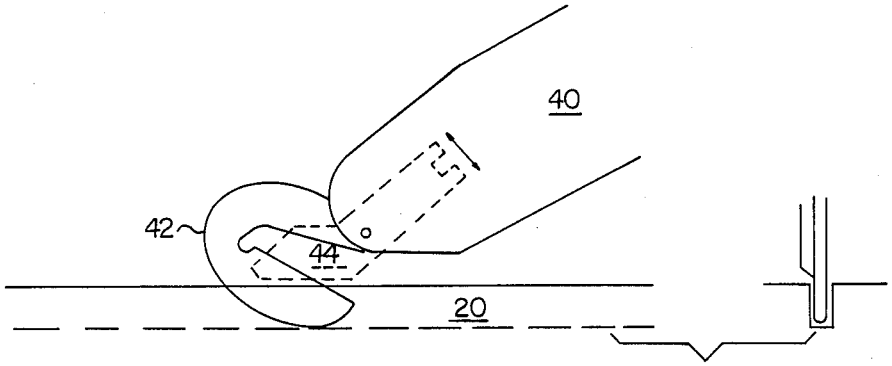
FIG. 12 shows an embodiment of an electric scissor.
Figure 13A:
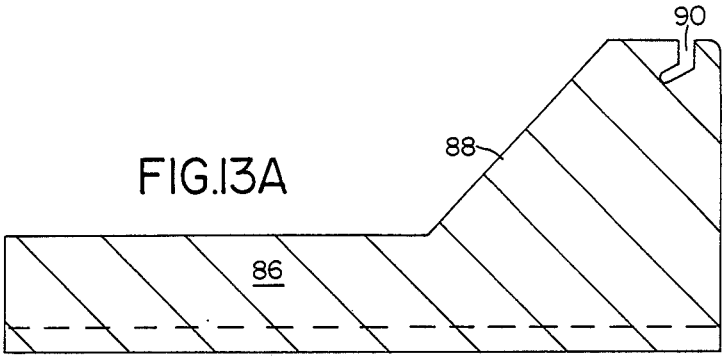
FIG. 13 shows a side-view of a further embodiment of the cutting rail with locking screw.
Figure 13B:
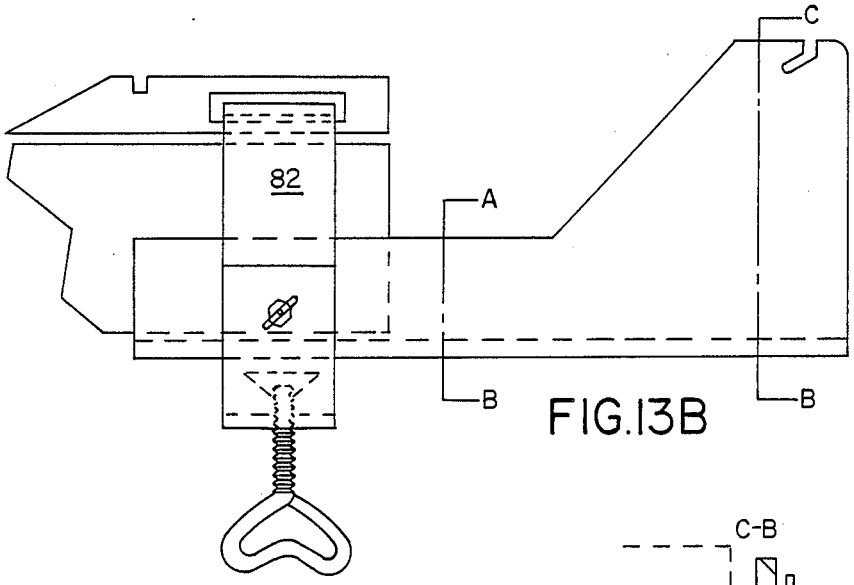
Figure 13C:
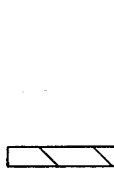
Figure 13D:
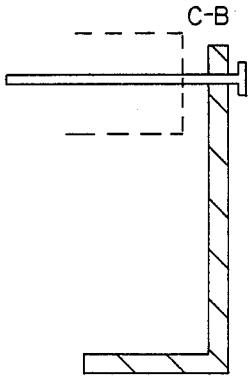
Figure 14A:
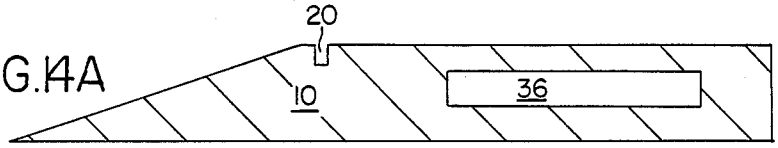
FIG. 14 shows a side-view of a similar embodiment with locking screw and pinch roll.
Figure 14B:
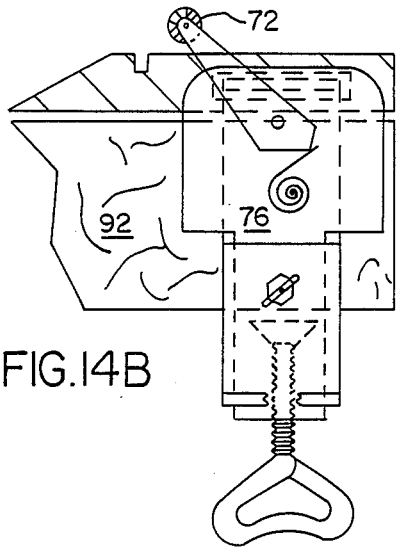
Figure 14C:
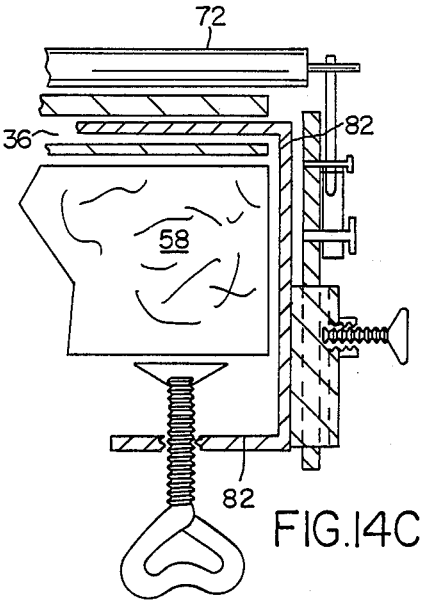
Figure 14D:
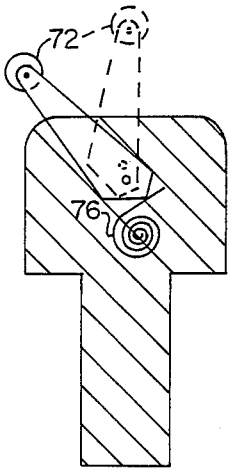
Figure 14E:
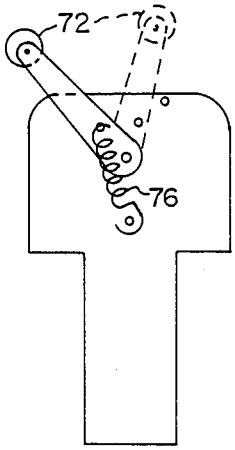
Figure 14F:
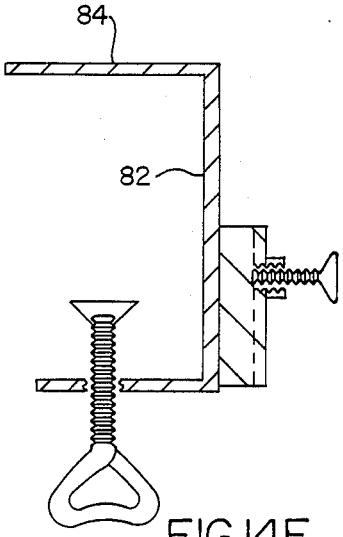

FIG. 12 shows a further embodiment of an electric scissor for "cutting backwards". The swivelling point 48 of the driven shearing blade 44 is located inside housing 50 in this design. The shearing blade, i.e., the driven shearing blade 44, can thus be shaped as desired, whatever the location of the swivelling point may be. This makes it possible to select the angle between driven shearing blade 44 and a fixed counterblade 42 at will. A greater range of design possibilities is thus afforded.

A further embodiment of the cutting rail 10 is shown in FIG. 13. This cutting rail is provided with a slit-like indentation 36 into which the lock 84 of a vise screw 82 can be inserted so that the cutting rail can be attached, for instance on a table 58.

It is furthermore possible to attache a guide 86 with a slit 90 at its raised end 88 to the locking screw, so that a roll of the material to be cut can be hooked into slit 90.

In the embodiment shown in FIG. 14, clamping rollers 72 are provided on the vise clamp 82 and are pushed downward by a clamp 76 in order to hold the material to be cut on cutting rail 10 on that rail. The clamping rollers are attached to an extension 92 of the locking screws 82.

The cutting device according to the invention for wall coverings and floor coverings comprises a cutting rail and an electric scissor which can be introduced into the cutting rail, wherein the cutting rail comprises a plastic extrusion profile segment with triangular cross-section and wherein the electric scissor is equipped with shearing blades, the cutting direction of which point toward the body of the operator.

The combined device makes it possible to obtain a clean cut without great expenditure of force, even uder difficult working conditions.

I claim:

1. A cutting device for wall and floor coverings, comprising a cutting rail for aligning said cutting device, said cutting rail including at least one cutting groove, and an electric scissors associated with said cutting rail, said electric scissors comprising a housing, a drive motor, a movable cutting blade, and a fixed cutting blade, said fixed cutting blade including a cutting edge oriented towards said housing, said movable cutting blade being driven by said motor and cooperating with said fixed cutting blade for cutting said wall and floor coverings in a direction oriented towards said housing, said fixed cutting blade being sized to be received within said cutting groove, said cutting rail comprising a plastic extrusion profile of triangular cross-section, said cutting rail including two support surfaces and a bearing surface, said two support surfaces being shorter than said bearing surface, said bearing surface including at least three cutting grooves, one of said cutting grooves being located on said bearing surface at a distance from the intersection of said bearing surface with one of said support surfaces equal to the length of said support surface.

2. The cutting device of claim 1 wherein one of said support surfaces extends beyond the intersection with said bearing surface and forms a protruding nose.

3. The cutting device of claim 1 wherein said bearing surface includes a raised edge extending from the triangular cross-section of said cutting rail.

4. A cutting device for wall and floor coverings, comprising a cutting rail for aligning said cutting device, said cutting rail including at least one cutting groove, and an electric scissors associated with said cutting rail, said electric scissors comprising a housing, a drive motor, a movable cutting blade, and a fixed cutting blade, said fixed cutting blade including a cutting edge oriented towards said housing, said movable cutting blade being driven by said motor and cooperating with said fixed cutting blade for cutting said wall and floor coverings in a direction oriented towards said housing, said fixed cutting blade being sized to be received within said cutting groove, wherein the depth of said cutting groove is about 0.5 to 2 mm less than the height of said fixed cutting blade.

* * * * *